US007404757B2

(12) United States Patent
Lujan

(10) Patent No.: US 7,404,757 B2
(45) Date of Patent: Jul. 29, 2008

(54) APPARATUS AND METHOD FOR BREAKING IN MULTIPLE PAD CONDITIONING DISKS FOR USE IN A CHEMICAL MECHANICAL POLISHING SYSTEM

(75) Inventor: Randall J. Lujan, Round Rock, TX (US)

(73) Assignees: Samsung Austin Semiconductor, L.P., Austin, TX (US); Samsung Electronics Co., Ltd., Suwon-si (KR)

( * ) Notice: Subject to any disclaimer, the term of this patent is extended or adjusted under 35 U.S.C. 154(b) by 315 days.

(21) Appl. No.: 10/873,557

(22) Filed: Jun. 22, 2004

(65) Prior Publication Data

US 2005/0282475 A1 Dec. 22, 2005

(51) Int. Cl.
*B24B 55/00* (2006.01)

(52) U.S. Cl. ..... 451/443; 451/285; 451/415

(58) Field of Classification Search ..... 451/56, 451/443, 41, 285, 287, 290, 415
See application file for complete search history.

(56) References Cited

U.S. PATENT DOCUMENTS 6,695,680 B2 * 2/2004 Choi et al. ..... 451/5
6,769,972 B1 * 8/2004 Huang et al. ..... 451/287
6,837,773 B2 * 1/2005 Brunelli ..... 451/7
6,935,938 B1 * 8/2005 Gotkis et al. ..... 451/443

* cited by examiner

*Primary Examiner*—Eileen P. Morgan

(57) ABSTRACT

An apparatus for breaking in new pad conditioning disks for use in a chemical mechanical polishing (CMP) system that polishes a semiconductor wafer by pressing the semiconductor wafer against a moving polishing pad. The apparatus comprises a break-in head that is removably attached to a drive shaft to which a polishing head that holds the semiconductor wafer is normally attached. The break-in head holds multiple pad conditioning disks and presses the plurality of pad conditioning disks against the moving polishing pad. The break-in head comprises a drive mechanism for rotating the multiple pad conditioning disks. The drive mechanism is coupled to the drive shaft and rotates the multiple pad conditioning disks by translating a rotating motion of the drive shaft into rotating motions of the multiple pad conditioning disks.

10 Claims, 4 Drawing Sheets

APPARATUS AND METHOD FOR BREAKING IN MULTIPLE PAD CONDITIONING DISKS FOR USE IN A CHEMICAL MECHANICAL POLISHING SYSTEM

CROSS-REFERENCE TO RELATED APPLICATION

The present invention is related to that disclosed in U.S. patent application Ser. No. 10/873,558, entitled "OFF-LINE TOOL FOR BREAKING IN MULTIPLE PAD CONDITIONING DISKS USED IN A CHEMICAL MECHANICAL POLISHING SYSTEM," filed concurrently herewith. The subject matter disclosed in patent application Ser. No. 10/873,558 is hereby incorporated by reference into the present disclosure as if fully set forth herein.

TECHNICAL FIELD OF THE INVENTION

The present invention is directed to chemical mechanical polishing (CMP) systems and, more specifically, to an apparatus for breaking in multiple pad conditioning disks in a CMP system.

BACKGROUND OF THE INVENTION

Chemical mechanical polishing (CMP), also called chemical mechanical planarization, is a well-known process for removing oxide and other deposits from the surface of a wafer. CMP systems are frequently used during the processing of silicon semiconductor wafers. CMP systems are made by a number of vendors, including Applied Materials, Inc., of Santa Clara, Calif. Many conventional CMP systems polish semiconductor wafers by abrading the surface of the wafer with a silica-based slurry.

FIG. 1 illustrates selected portions of chemical mechanical polishing (CMP) system 100 according to an exemplary embodiment of the prior art. CMP system 100 comprises support platform 101, platen 105, polishing pad 110, pad conditioning disk 115, spindle 120, disk actuator 125, motor 130, and drive shaft 135. CMP system 100 further comprises motor 130, drive shaft 145, polishing head 150, motor 160, drive shaft 165, and slurry dispenser 170. Applied Materials (AMAT) manufactures the AMAT Mirra™ CMP system, which houses three CMP systems similar to CMP system 100 in an enclosure. It is noted that the components of CMP system 100 depicted in FIG. 1 are not drawn to scale. Rather, the sizes and relative positions of the components of CMP system 100 are selected for easy reference and explanation.

The operation of CMP system 100 is widely understood. Drive motor 140 and drive shaft 145 rotate platen 105 and polishing pad 110. Slurry dispenser 170 dispenses onto polishing pad 110 a silica-based slurry made from de-ionized water mixed with $SiO_2$ (or KOH). Rotation of pad 110 carries the slurry underneath polishing head 150. A silicon wafer (not shown) is attached to the bottom surface of polishing head 150, which may be, for example, a Titan™ polishing head from Advanced Material, Inc. The wafer may be held in place on the bottom surface of polishing head 150 by vacuum pressure created by a membrane.

Motor 160 and drive shaft 165 rotate polishing head 150 and the attached wafer and press polishing head 150 and attached wafer downward onto polishing pad 110. This downward pressure forces the exposed surface of the attached silicon wafer into firm contact with the moving slurry dispensed on rotating polishing pad 110. The movement and pressure of the slurry abrades the exposed surface of the silicon wafer. The abrasion removes silicon oxide or other materials that are deposited on the exposed surface of the silicon wafer attached to the bottom of polishing head 150.

The efficient operation of CMP system 100 requires that the surface of polishing pad 110 be continually conditioned by pad conditioning disk 115. Polishing pad 110 may be made of polyurethane, for example. The surface of polishing pad 110 is covered by tiny grooves (e.g., depth=0.03 inch) that capture slurry particles. Pad conditioning maintains an acceptable oxide removal rate and stable performance. Pad conditioning helps maintain optimal pad roughness and porosity, thereby ensuring the even transport of slurry to the wafer surface. Without conditioning by pad conditioning disk 115, the surface of polishing pad 110 glazes and oxide removal rates decline.

The bottom surface of disk 115 is coated by an abrasive layer, such as a layer of nickel in which fine diamonds are embedded. Diamond pad conditioning disks are the most widely used method of pad conditioning in wafer fabrication facilities today. Pad conditioning disk 115 refreshes (or wears) the surface of polishing pad 110 during CMP processing to thereby maintain a uniform surface on polishing pad 110.

Disk actuator 125, motor 130 and drive shaft 135 drive pad conditioning disk 115, which is rigidly attached to spindle 120. Disk actuator 125 and drive shaft 135 contain the necessary gearing and other drive mechanisms to rotate spindle 120, thereby rotating disk 115. Disk actuator 125 and drive shaft 135 also contain the necessary drive mechanisms to sweep rotating disk 115 back and forth across the surface of rotating polishing pad 110.

The performance of pad conditioning disk 115 has a significant impact on the cost of operating CMP system 100. Aggressive use of pad conditioning disk 115 gives good process performance, but rapidly wears out polishing pad 110, thereby reducing pad life and increasing cost. A less aggressive use of pad conditioning disk 115 may not provide enough conditioning to polishing pad 110, resulting in unstable process performance.

Disk flatness is an important aspect of pad conditioning disk 115, since uniform wear across polishing pad 110 increases pad life and process stability. To ensure disk flatness, a new pad conditioning disk 115 must be broken, in prior to use in an on-line CMP process. The process of breaking in a new disk 115 typically involves taking CMP system 100 off line, removing the wafer and polishing head 150, and attaching new disk 115 to spindle 120. Next, new disk 115 scours the surface of pad 110 for about 30 minutes, until the bottom surface of disk 115 is evenly worn.

At this point, broken-in disk 115 is removed, pad 110 is replaced with a new pad, polishing head 150 is re-attached, and CMP system 100 is re-qualified. The process of re-qualifying CMP system 100 may require another two hours. The AMAT Mirra™ CMP system, which houses three CMP systems similar to CMP system 100 in a single housing, may break in three pad conditioning disks 115 at a time. Nonetheless, the process of breaking-in pad conditioning disk 115 may take CMP system 100 off line for two and a half hours.

It is important to improve process performance by increasing productivity and reducing cost of ownership. However, taking CMP system 100 off line to break in new disks 115 makes achieving these goals more difficult. Reducing off-line time has the added benefit of minimizing the frequency of tool re-qualification, resulting in higher availability and more finished wafers per month.

Therefore, there is a need in the art for an improved chemical mechanical polishing (CMP) system that has reduced off-line time. In particular, there is a need for an improved system and method for breaking in pad conditioning disks that reduce the amount of time that a chemical mechanical polishing (CMP) system must be taken off line.

SUMMARY OF THE INVENTION

The present invention introduces a novel multiple disk break-in head that may be used in a conventional chemical mechanical polishing (CMP) system to increase the number of pad conditioning disks that may be broken in whenever a CMP system is taken off line. The multiple disk break-in head replaces the removed polishing head when new disks are broken in on the CMP system. Thus, the number of disks that can be broken in may be greatly increased each time a CMP system is taken off line. For example, if three break-in heads holding four disks each are used in an AMAT Mirra™ CMP system, twelve additional disks may be broken in at the same time as the three disks that the AMAT Mirra™ CMP system can normally break in.

To address the above-discussed deficiencies of the prior art, it is a primary object of the present invention to provide, for use in a chemical mechanical polishing (CMP) system that polishes a semiconductor wafer by pressing the semiconductor wafer against a moving polishing pad, an apparatus for breaking in new pad conditioning disks. According to an advantageous embodiment of the present invention, the apparatus comprises a break-in head capable of being removably attached to a drive shaft to which a polishing head that holds the semiconductor wafer is normally attached. The break-in head is adapted to receive and to hold at least one pad conditioning disk and to press the at least one pad conditioning disk against the moving polishing pad.

According to one embodiment of the present invention, the break-in head comprises a drive mechanism capable of rotating the at least one pad conditioning disk.

According to another embodiment of the present invention, the break-in head is adapted to receive and to hold a plurality of pad conditioning disks and to press the plurality of pad conditioning disks against the moving polishing pad.

According to still another embodiment of the present invention, the break-in head comprises a drive mechanism capable of rotating the plurality of pad conditioning disks.

According to yet another embodiment of the present invention, the drive mechanism is coupled to the drive shaft and rotates the plurality of pad conditioning disks by translating a rotating motion of the drive shaft into rotating motions of the plurality of pad conditioning disks.

According to a further embodiment of the present invention, the drive mechanism comprises a gear assembly coupled to the drive shaft and to each of a plurality of spindles connected to the plurality of pad conditioning disks.

According to a still further embodiment of the present invention, the gear assembly comprises a center gear coupled to the drive shaft and a first drive gear coupled to a first one of the plurality of spindles.

According to a yet further embodiment of the present invention, the gear assembly further comprises a first transfer gear that interacts with the center gear and the first drive gear to transfer rotating motion between the center gear and the first drive gear.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 2:
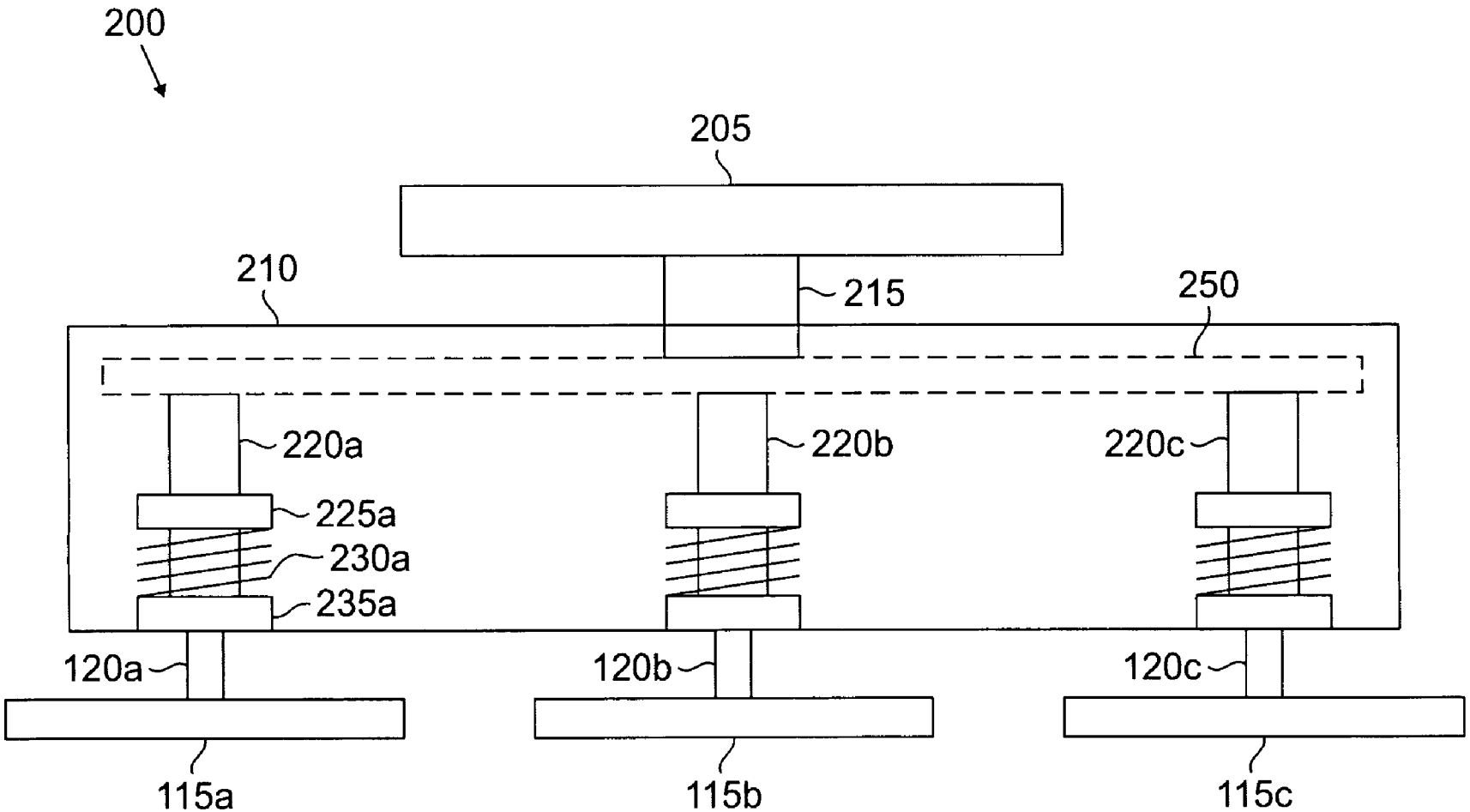
FIG. 2 illustrates a side view of a multiple disk break-in head according to an exemplary embodiment of the present invention.
Figure 3:
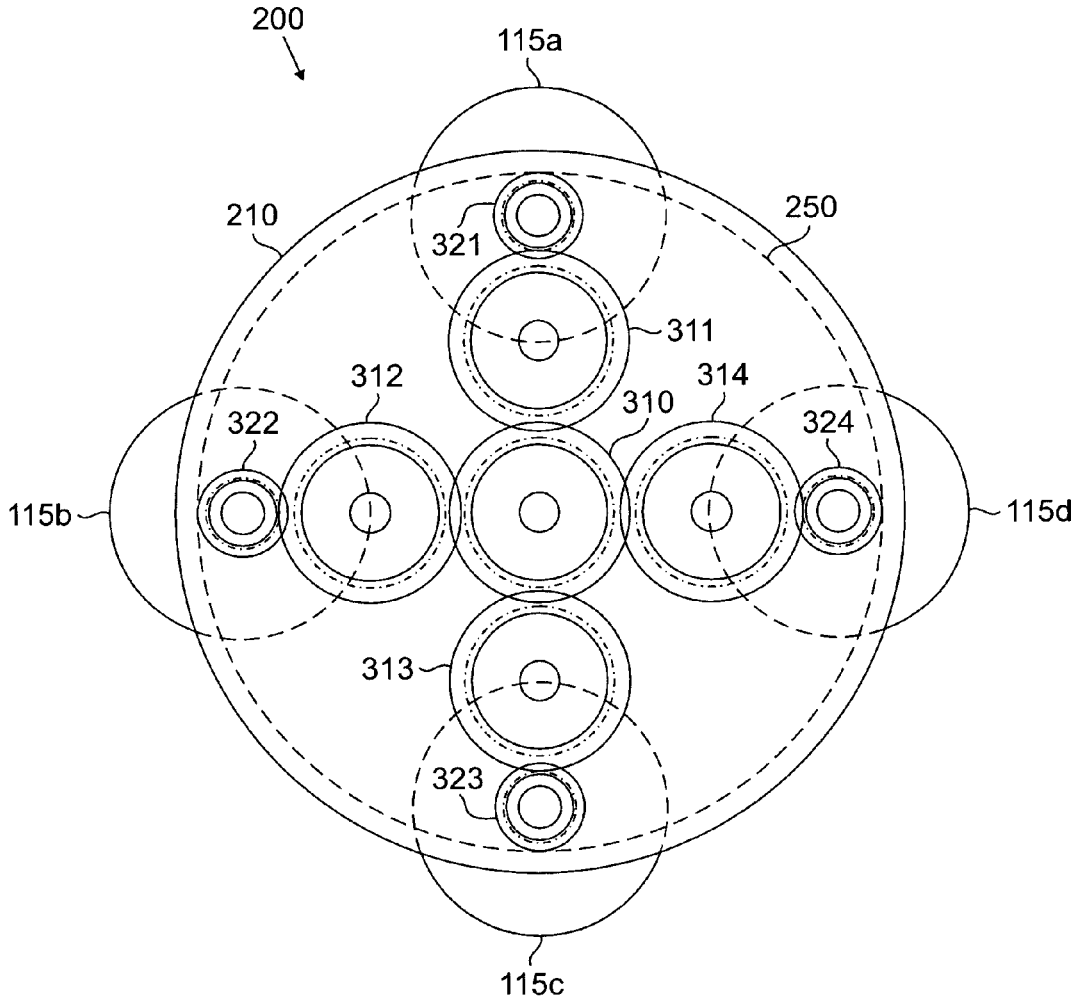
FIG. 3 illustrates a top view of a multiple disk break-in head according to an exemplary embodiment of the present invention.
Figure 4:
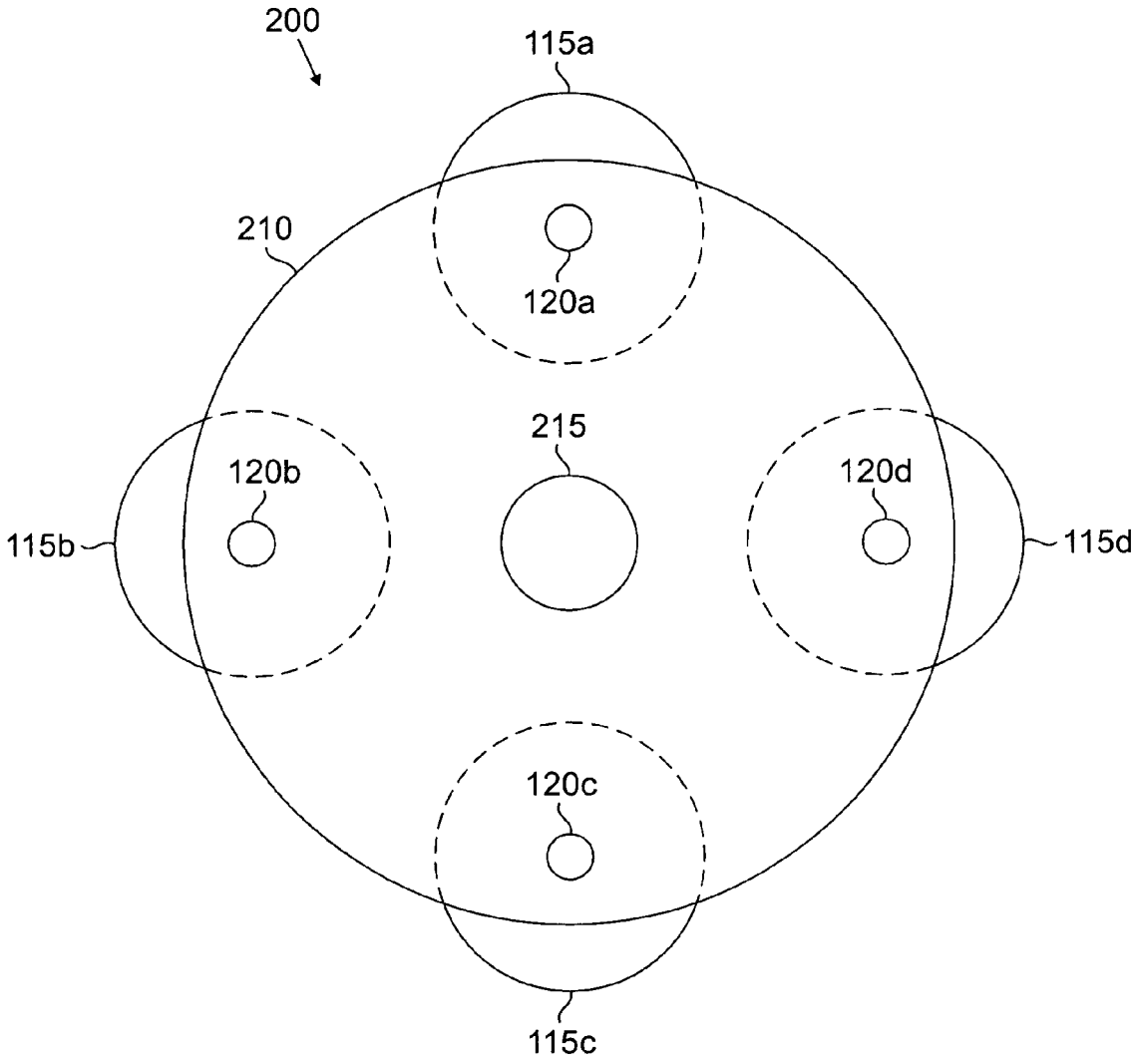
FIG. 4 illustrates a top view of a multiple disk break-in head according to an alternate exemplary embodiment of the present invention.

FIGS. 2 through 4, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged chemical mechanical polishing (CMP) system.

Figure 1:
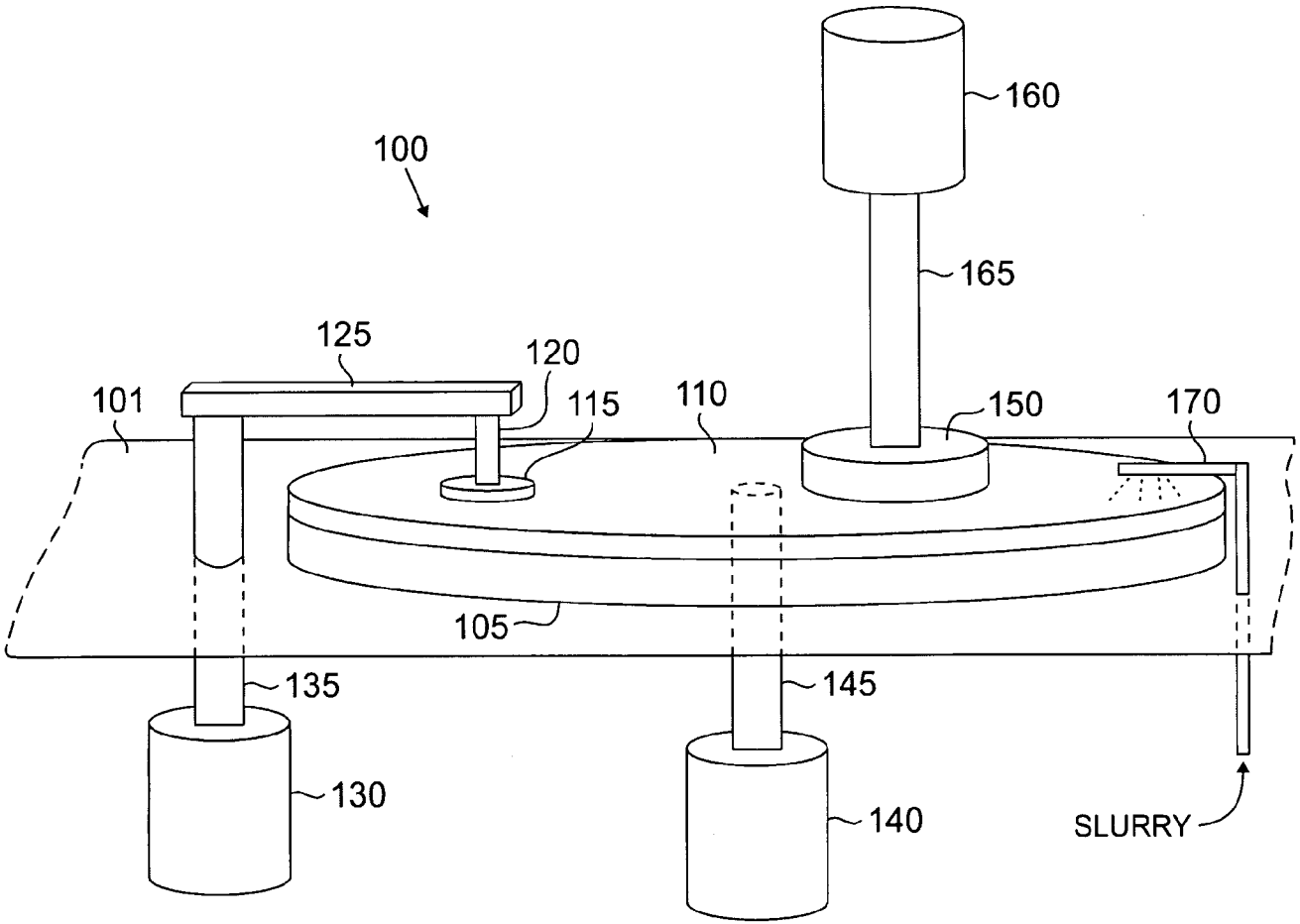
FIG. 1 (PRIOR ART)
FIG. 1 illustrates selected portions of a chemical mechanical polishing (CMP) system according to an exemplary embodiment of the prior art.

FIG. 2 illustrates a side view of selected portions of multiple disk break-in head 200 according to an exemplary embodiment of the present invention. When CMP system 100 is taken off line, polishing head 150 is removed and break-in head 200 is installed in CMP system 100 in place of polishing head 150. The exemplary embodiment of break-in head 200 holds four pad conditioning disks 115, namely disk 115*a*, disk 115*b*, disk 115*c* and disk 115*d* (not visible in FIG. 1). In alternate embodiments of the present invention, break-in head 200 may hold more than four disks 115 or less than four disks 115.

Multiple disk break-in head 200 comprises coupling 205, circular housing 210, drive shaft 215, and drive mechanism 250 (shown by dotted outline). Coupling 205 is used to attach break-in head to drive shaft 165 in CMP system 100. Drive shaft 215 transfers the rotation of drive shaft 165 to drive mechanism 250.

Break-in head 200 further comprises four spindles 120, namely spindle 120*a*, spindle 120*b*, spindle 120*c* and spindle 120*d* (not visible in FIG. 2). Disk 115*a* is removably coupled to spindle 120*a*, disk 115*b* is removably coupled to spindle 120*b*, disk 115*c* is removably coupled to spindle 120*c*, and disk 115*d* is removably coupled to spindle 120*d*.

Break-in head 200 also comprises four drive shafts 220, including drive shaft 220*a*, drive shaft 220*b*, drive shaft 220*c*, and drive shaft 220*d* (not visible in FIG. 2). Spindles 120 are coupled to drive shafts 220 by retaining rings 225, springs 230, and retaining rings 235. For example, retaining ring 235*a* is rigidly attached to spindle 120*a* and to drive shaft 220*a*. Retaining ring 225*a* is rigidly attached to the body of housing 210 and is slidably coupled to drive shaft 220. Drive shaft 220 is slidably attached to a drive gear in drive mechanism 250.

When break-in head 200 is pressed down on pad 110, spindle 120*a* and retaining ring 235*a* press upward on spring 230*a*. Drive shaft 220*a* also is pressed upward by retaining ring 230*a*. The upward movement of drive shaft 220*a* is accommodated by the slidable coupling to the gears in drive mechanism 250. Retaining ring 225*a* is rigidly attached to housing 210 and resists the upward movement of spring 230*a*. Thus, the pressure of disk 115*a* against the surface of pad 110 is determined by the characteristics of spring 230*a*.

Disks 115*b*, 115*c* and 115*d* are connected to drive shafts 220*b*, 220*c* and 220*d* by similar assemblies of retaining rings, spindles, and springs. The operation of these other assemblies are similar to the operation of ring 225*a*, ring 235*a*, and spring 230*a* and need not be explained separately. To avoid redundancy, such separate explanations are omitted.

FIG. 3 illustrates a top view of selected portions of multiple disk break-in head 200 according to an exemplary embodiment of the present invention. Exemplary drive mechanism 250 is bounded by a dotted line. Exemplary drive mechanism 250 comprises central gear 310, transfer gears 311-314 and drive gears 321-324. Disks 115*a*-115*d* are positioned below break-in head 200 and are shown in partial dotted outlines.

Central gear 310 is coupled to, and rotated by, drive shaft 215. Transfer gear 311 transfers the rotation of central gear 310 to drive gear 321, which in turn causes the rotation of disk 115*a*. Transfer gear 312 transfers the rotation of central gear 310 to drive gear 322, which in turn causes the rotation of disk 115*b*. Transfer gear 313 transfers the rotation of central gear 310 to drive gear 323, which in turn causes the rotation of disk 115*c*. Transfer gear 314 transfers the rotation of central gear 310 to drive gear 324, which in turn causes the rotation of disk 115*d*.

In this manner, the rotation of drive shaft 165 in CMP system 100 causes the individual rotations of each of disks 115*a*, 115*b*, 115*c* and 115*d*. The relative sizes of central gear 310, transfer gears 311-314, and drive gears 321-324 determine the speed of rotation of disks 115*a*-115*d*.

The exemplary arrangement of the gears in drive mechanism 250 is by way of example only and should not be construed to limit the scope of the present invention. Those skilled in the art will readily understand that many other types of mechanical drive systems may be used to rotate pad conditioning disks 115*a*-115*d*. For example, in an alternate embodiment, a single large central gear 310 may directly couple to drive gears 321-324 without the use of intermediate transfer gears. In still other embodiments, belts or chains may be used to rotate disks 115*a*-115*d*.

FIG. 4 illustrates a top view of selected portions of multiple disk break-in head 200 according to an alternate exemplary embodiment of the present invention. In FIG. 4, drive mechanism 250 has been removed entirely, so that disks 115*a*-115*d* are not driven by drive shafts 165 and 215. Nonetheless, pad conditioning disks 115*a*-115*d* rotate when pressed down upon pad 110 due to the speed differences between different points on the surface of pad 110. Surface points near the outer diameter of pad 110 must move at a faster speed than surface points near the center of rotation of pad 110 in order to complete one rotation in the same time period. Thus, a first point on the bottom surface of disk 115 that is closer to the center of pad 110 contacts a slower moving portion of the surface of pad 110 than a second point on the bottom surface of disk 115 that is further from the center of pad 110. Thus, there is a greater amount of friction at the second point.

Spindle 120 is at the center of rotation of disk 115. Collectively, the combined friction of all of the points on the bottom surface of disk 115 that are located to the side of spindle 120 closer to the center of pad 110 is less than the combined friction of all of the points on the bottom surface of disk 115 that are located to the side of spindle 120 that is further from the center of pad 110. The friction difference causes disk 115 to rotate about spindle 120, even in the absence of drive mechanism 250.

The present invention overcomes the shortcomings of conventional chemical mechanical polishing (CMP) systems by greatly increasing the number of pad conditioning disks that may be broken in whenever a CMP system is taken off line. Instead of mounting only one new disk 115 on spindle 120 in FIG. 1, multiple (e.g., 4) other new disks 115 are mounted on other spindles 120 on break-in head 200 (which replaced polishing head 150) and are broken-in at the same time.

Although the present invention has been described with an exemplary embodiment, various changes and modifications may be suggested to one skilled in the art. It is intended that the present invention encompass such changes and modifications as fall within the scope of the appended claims.

What is claimed is:

1. For use in a chemical mechanical polishing (CMP) system that polishes a semiconductor wafer by pressing the semiconductor wafer against a moving polishing pad, an apparatus for breaking in new pad conditioning disks comprising:

a break-in head capable of being removably attached to a drive shaft to which a polishing head that holds the semiconductor wafer is normally attached, wherein the break-in head is adapted to receive and to hold a plurality of pad conditioning disks and to press said pad conditioning disks against said moving polishing pad, and wherein a gear assembly of a drive mechanism is coupled to said drive shaft and to a plurality of spindles for rotating said spindles and said pad conditioning disks.

2. The apparatus as set forth in claim 1 wherein said drive mechanism rotates said at least one of said pad conditioning disks by translating a motion of said drive shaft into a motion of said at least one of said pad conditioning disks.

3. The apparatus as set forth in claim 2 wherein said drive mechanism rotates said at least one of said pad conditioning disks by translating a rotating motion of said drive shaft into a rotating motion of said at least one of said pad conditioning disks.

4. The apparatus as set forth in claim 1 wherein said gear assembly comprises a center gear coupled to said drive shaft and a drive gear coupled to one of said spindles.

5. The apparatus as set forth in claim 4 wherein said gear assembly further comprises a transfer gear that interacts with said center gear and said drive gear to transfer rotating motion between said center gear and said drive gear.

6. The apparatus as set forth in claim 1 each of said plurality of spindles is connected to at least one of said plurality of pad conditioning disks.

7. The apparatus as set forth in claim 6 wherein said gear assembly comprises a center gear coupled to said drive shaft and a first drive gear coupled to a first one of said plurality of spindles.

8. The apparatus as set forth in claim 7 wherein said gear assembly further comprises a first transfer gear that interacts with said center gear and said first drive gear to transfer rotating motion between said center gear and said first drive gear.

9. The apparatus as set forth in claim 8 wherein said gear assembly further comprises a second drive gear coupled to a second one of said plurality of spindles.

10. The apparatus as set forth in claim 9 wherein said gear assembly further comprises a second transfer gear that interacts with said center gear and said second drive gear to transfer rotating motion between said center gear and said second drive gear.

* * * * *